United States Patent [19]

Comparon

[11] Patent Number: 4,702,157

[45] Date of Patent: Oct. 27, 1987

[54] AUTOMATIC AERATION WINDOW

[76] Inventor: Jean-Daniel Comparon, 22, rue de Metz, F-68071 Mulhouse Cedex, France

[21] Appl. No.: 885,606

[22] PCT Filed: Oct. 23, 1985

[86] PCT No.: PCT/FR85/00299

§ 371 Date: Jun. 23, 1986

§ 102(e) Date: Jun. 23, 1986

[87] PCT Pub. No.: WO86/02692

PCT Pub. Date: May 9, 1986

[30] Foreign Application Priority Data

Oct. 31, 1984 [FR] France ..... 84 16778

[51] Int. Cl.[4] ..... E06B 7/10

[52] U.S. Cl. ..... 98/97; 49/38; 98/38.1; 98/94.1

[58] Field of Search ..... 98/88.1, 94.1, 97, 99.01, 98/98, 99.8; 52/171; 49/38

[56] References Cited

U.S. PATENT DOCUMENTS

| | | | |
|---|---|---|---|
| 141,254 | 7/1873 | Bates | 98/97 |
| 1,121,542 | 12/1914 | Wegner | 98/94.1 X |
| 1,153,067 | 9/1915 | Hackney | 98/94.1 |
| 2,324,139 | 7/1943 | Davis | 98/88.1 X |
| 2,818,611 | 1/1958 | Andree | 98/88.1 X |
| 3,034,416 | 5/1962 | Powell | 98/98 |
| 3,255,688 | 6/1966 | Iwata | 98/98 |
| 3,590,913 | 7/1971 | Tschudin | 52/171 X |

FOREIGN PATENT DOCUMENTS

| | | | |
|---|---|---|---|
| 2608557 | 9/1977 | Fed. Rep. of Germany | 98/88.1 |
| 1207656 | 2/1960 | France . | |
| 1573447 | 7/1969 | France . | |
| 2517354 | 6/1983 | France . | |
| 2437484 | 9/1983 | France . | |
| 8400782 | 10/1985 | Netherlands | 49/38 |
| 1518928 | 7/1978 | United Kingdom . | |

*Primary Examiner*—Albert J. Makay
*Assistant Examiner*—Steven E. Warner
*Attorney, Agent, or Firm*—Frost & Jacobs

[57] ABSTRACT

An automatic aeration window comprises a movable frame with three parallel window panes separated by gaps, a first lower passage and a second lower passage at the bottom of the window and an upper intermediate passage connecting the two at the top of the mobile frame. In order to enable a light-weight construction of the movable window frame, the first lower passage, connected to an external opening on the outer face of the window and to a first lower opening, is provided in the fixed frame of the window. A closing flap controlled by a puller is also mounted in the fixed window frame, while the second lower passage preferably also passes through this fixed frame. The invention may be used in windows to provide aeration and good acoustic and thermal insulation.

17 Claims, 6 Drawing Figures

AUTOMATIC AERATION WINDOW

The present invention relates to a window with automatic aeration for buildings, which comprises a mobile frame on a fixed frame, three parallel window panes mounted in this frame, a first gap between the outer pane and the intermediate pane and a second gap between the intermediate pane and the inner pane, an aerating circuit with baffles composed of at least one inlet passage arranged at the bottom of the window for connecting outside air to the first gap, at least one intermediate passage provided in the upper part of the mobile frame for connecting the first gap to the second gap and at least one outlet passage arranged at the bottom of the window for connecting the second gap to air within the building, at least one adjusting and closing flap disposed in this circuit and means for controlling this flap, provided with a control member on the inner face of the window.

From French Pat. No. 2,437,484, a window of this type is known, in which the inlet and outlet passages are provided in the mobile frame of the window. This frame is equipped with shutters arranged to limit or stop the circulation of air between the window panes, as well as with members for manual control of these shutters. This window allows aeration of the room in which it is mounted, while ensuring excellent acoustic insulation. However, it presents various drawbacks with regard to its construction and use. In particular, the lower part of the frame, enclosing the shutters and the control members, is relatively voluminous, whereby the free surface of the window panes is reduced. The weight of the mobile frame is moreover greater than that of a conventional frame. On the other hand, it is difficult to solve the problems of sealing at the bottom of the outer window pane in a satisfactory manner, so that operation of the shutters or satisfactory stability of the window are not ensured, if one does not effect regular maintenance. Moreover, with its relatively heavy and voluminous frame, this system is inconvenient on a window of the guillotine type.

Consequently, the present invention has the object of meeting these drawbacks, by providing a window equipped with an air circuit which permits aeration when the window is closed, this window being of simple and sturdy construction, necessitating little maintenance, comprising a relatively light frame, while ensuring good thermal and acoustic insulation.

For this purpose, the present invention relates to a window of the type mentioned in the preamble, characterized in that the fixed frame comprises on its outer surface, at least one inlet opening which is connected to the first gap by the inlet conduit, and in that said flap is mounted on the fixed frame, as well as its control means.

The flap is preferably arranged to be able to shut the inlet opening. This flap may be pivoted round a horizontal axis on at least one support solid with the fixed frame. The shutter is in particular advantageously disposed on the outer face of the window. The pivoting axis of the flap is preferably situated higher than the opening to be shut, the flap being arranged in such a manner with respect to the pivoting axis that it can shut by its own weight.

The means for controlling the flap preferably include a puller comprising a rod arranged to slide in the fixed window frame, a handle fixed to the extremity of this puller on the inner side of the window, the outer extremity of the rod being in contact with the flap, and a latching mechanism with catches permitting locking of the puller in at least two given axial positions. In this arrangment, combined with a flap pivoting around a horizontal axis, the second extremity of the rod and the flap may comprise coupling means for actuating the flap by the puller in one direction and in the other. In that case, the rod is advantageously connected to the handle by spring means.

According to a preferred embodiment, the outlet passage passes through the fixed frame of the window.

This embodiment presents various advantages which will be described hereinafter. In particular, an electric ventilator may thus be connected to the aerating circuit. This ventilator may be mounted in the fixed frame of the window. If the flap is adapted to shut the inlet opening, the ventilator may be disposed in parallel with said inlet opening and be connected on one hand to an external opening equipped with a mobile closing member and on the other hand, to the inlet passage, the fixed frame of the window being equipped with means for controlling the ventilator and the closing member.

According to another variant, the ventilator may constitute a part of an air conditioner.

According to another embodiment, the outlet passage passes only through the mobile frame.

The air circuit may in all cases comprise a removable filter disposed in the fixed frame.

In a window according to the present invention, the three window panes preferably have the same dimensions. The mobile frame may comprise three elements which are articulated with respect to each other, each of these elements serving as a frame for one of the window panes.

The present invention and its advantages may be better understood with reference to the description given below by way of example of various embodiments with reference to the accompanying drawings, wherein.

Figures 1, 2:
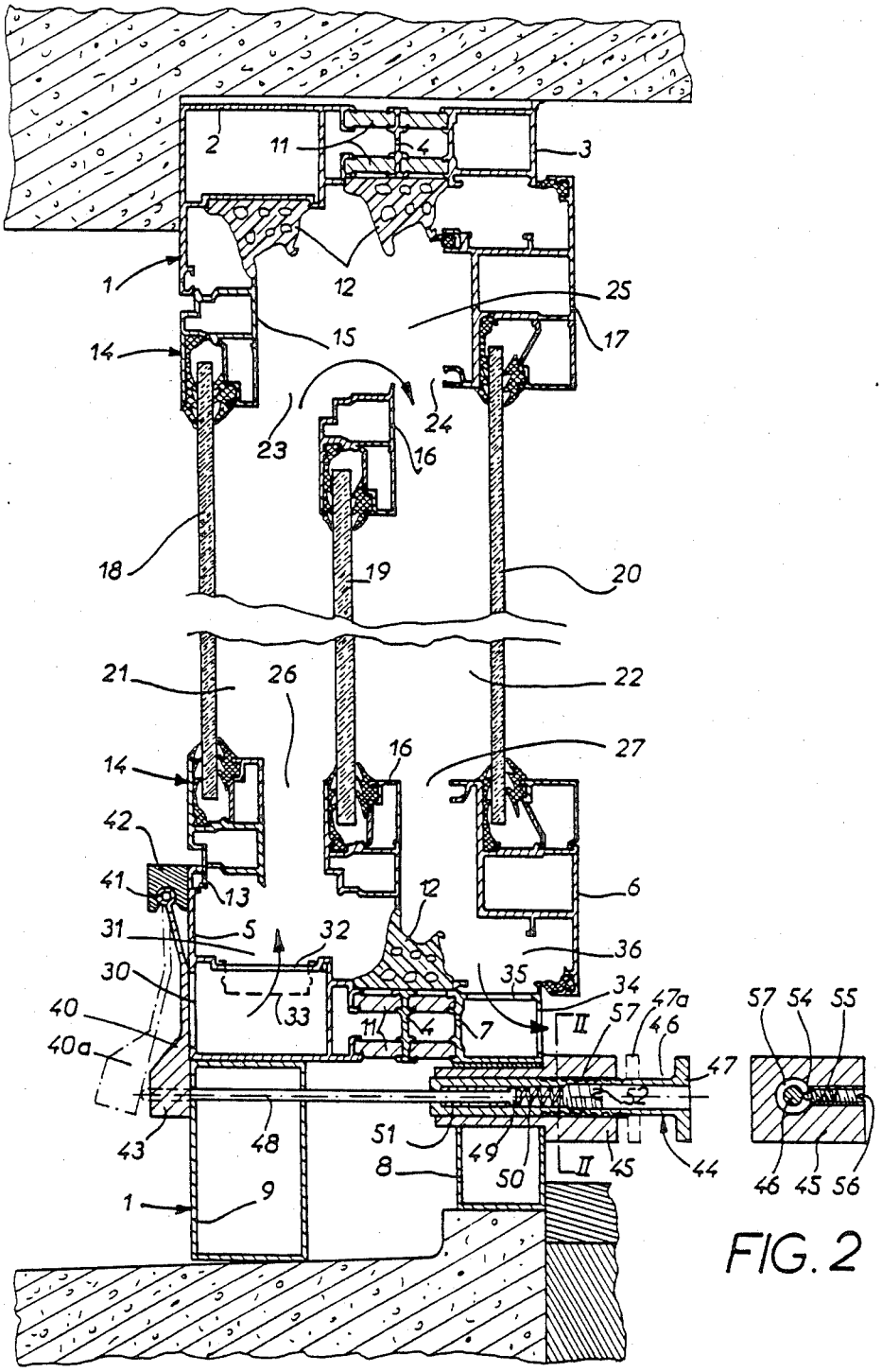
FIG. 1 is a vertical transverse section of a preferred embodiment of the window according to the invention.
FIG. 2 is a vertical section along line II—II of FIG. 1.

The window represented in FIG. 1 comprises a fixed frame 1 including metal sections 2 to 9 and sealing strips 11, 12 and 13 of synthetic material or rubber, and a mobile frame 14 pivotally mounted on the fixed frame, for example by means of hinges (not shown), so that it may tilt to open the window. The mobile frame 14 actually comprises three frame elements 15, 16 and 17 which surround and respectively support three parallel window panes, namely an outer pane 18, and intermediate pane 19 and an inner pane 20. The frame elements 15, 16 and 17 are fixed together along the sides of the window in a manner known per se, for example by means of hinges along one of the sides and screws along the other, to permit their separation with a view to cleaning the interior of the window. Between the window panes, a first gap is defined which is situated between the outer pane 18 and the intermediate pane 19, and a second gap 22 situated between the intermediate pane 19 and the inner pane 20.

Above the first gap 21, the mobile frame comprises one or several slits 23 provided between the frame elements 15 and 16. One or several slits 24 are likewise provided between the two frame elements 16 and 17, above the second gap 22. The respective-slits 23 and 24 are in communication within the mobile frame 14 by means of an intermediate passage 25 situated above the intermediate window pane 19 and its frame element 16. In a variant, the intermediate passage 25 may also consist of slits passing through the upper part of the frame element 16. Thanks to the intermediate passage 25, air enclosed in the first gap 21 is in communication with air present in the second gap 22.

The lower part of the mobile frame 14 likewise comprises one or several slits 26 provided between the frame elements 15 and 16 above the first gap 21 and one or several slits 27 provided between the frame elements 16 and 17 above the second gap 22. When the window is closed, as is shown in FIG. 1, the slits 26 and 27 are not in communication below the intermediate window pane 19, because they are separated by the intermediate frame element 16 resting against the sealing strip 12 of the fixed frame.

The slits 23, 24, 26 and 27 are preferably continuous over the whole length of the window. However, they may be divided by providing several consecutive slits, separated by transverse braces which ensure support of the intermediate frame element 16, against the frame elements 15 and 17 to increase the rigidity of the mobile frame.

In accordance with the invention, the fixed frame 1 comprises on its outer face an inlet opening 30 which is connected to the first gap 21 by an inlet passage 31 extending both through the fixed frame and, by the slits 26, into the mobile frame. In the example shown, the inlet passage 31 passes through a horizontal openings 32 of the fixed frame, in which a removable filter 33 is disposed, represented schemetically in dashed lines, and serves to stop dust, insects, etc.

The openings 30 and 32 preferably extend over a major part of the width of the window, but they may also consist of several juxtaposed openings.

The lower part of the fixed frame 1 likewise comprises, on the inner side of the window, an outlet openings 34, a horizontal opening 35 and an outlet passage 36 which connects the second gap 22 to the outlet opening 34 while passing through the slit 27. One thus obtains an air circuit going from the inlet opening 30 to the outlet opening 34 via the inlet passage 31, the first gap 21, the intermediate passage 25, the second gap 22 and the outlet passage 36, through which circuit air may pass as indicated by the arrows in FIG. 1, or in the opposite direction in some cases.

This circuit comprises a great number of baffles, due particularly to the fact that air introduced into the lower part of the window is deviated up to the upper part, then must go down again, thereby ensuring a very great attenuation of external noise transmitted by air to the interior of the building.

To partially or completely close the inlet opening 30, in order to allow adjustment or interruption of the circulation of air, a flap 40 is mounted on the outer face of the fixed frame of the window.

This flap 40 consists of a section of metal or synthetic material which extends over a major part of the width of the window. Its rear face comprises a plane portion arranged to completely cover the inlet opening or openings 30 extending along the window. Along its upper edge, the flap 40 comprises a cylindrical weatherstrip 41 which defines a horizontal pivoting axis. This weatherstrip is placed in a cylindrical groove of one or several supports 42 fixed to the window frame. On the other hand, the lower part 43 of the flap 40 has an enlarged form, so that the center of gravity of the flap is offset outwardly with respect to the pivoting center, whereby the flap 40 tends to shut by its own weight.

To control the position of the flap 40, the window according to the invention simply comprises a puller 44 which is mounted in a lower part of the fixed frame 1. In the example illustrated in FIG. 1, the puller 44 comprises a support 45, a sliding sleeve 46 provided with a handle in the form of a button 47 on the inner side of the window, and a sliding rod 48 whose outer end rests against the flap 40. The other end of the rod 48 comprises a head 49 which is held in the sleeve 46 between two springs 50 and 51 by means of an adjusting screw 52, in order to attenuate the transmission to the puller 44 of shocks which may be produced by the flap 40 on the rod 48.

The puller 44 further comprises a latching mechanism with catches allowing locking of the puller in several given axial positions, corresponding to several positions of the flap 40. This mechanism is illustrated in FIGS. 1 and 2. The support 45 of the puller comprises, in a lateral bore, a device called a "ball screw" consisting in a manner known per se of a ball 54, a helical spring 55 and a screw 56 ensuring pressure of the spring against the ball. The sleeve 46, arranged to slide axially in the support 45, comprises on its periphery a series of circular grooves 57 in which the ball 54 may be engaged to lock the axial position of the sleeve 46. Each groove 57 thus corresponds to a given position of the puller 44 and the flap 40.

In EIG. 1, the puller 44 is shown in the closing position of the flap 40. When the puller is displaced by bringing the button 47 into the position **47*a* drawn in dashed lines, the end of the rod 48 pushes the flap 40 up into an opening position 40*a* drawn in dashed lines, then maintains it in that position due to the effect of the ball screw engaged in the corresponding slot 57**. The air circuit passing through the window is then open and aeration takes place according to the conditions reigning inside and outside the building.

Most of the time, the air is warmer within the building and the latter will comprise ventilating ducts which favor draught, so that air will tend to enter through the window according to the invention and to circulate as indicated by the arrows in FIG. 1. The utilizer may to a certain extent adjust the air flow by means of the flap 40 by acting on the puller 44.

Figure 3:
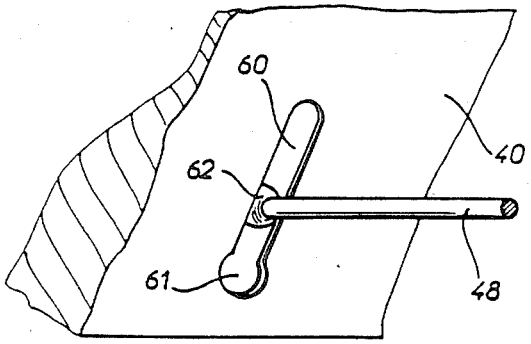
FIG. 3 is a schematic perspective view representing means for coupling the puller and the flap.

In the embodiment described above, the shutter simply rests against the extremity of the rod 48 of the puller or against the outer face of the frame, so that it may be raised in certain cases, for example by violent gusts of wind. Such a movement may produce disagreable noise or air currents in the building. FIG. 3 illustrates an arrangment which meets this drawback by means of a milled groove 60 in the rear part of the flap 40, which groove is oriented perpendicularly to the pivoting axis of the flap and presents a substantially cylindrical section, narrower at the surface of the flap than in depth. At its lower end, the groove 60 comprises an inserting orifice 61 whose diameter is equal to that of the cylinder inscribed in the groove 60. The rod 48 utilized in this case is provided at its end with a spherical button 62, which is introduced by the inserting orifice 61 and which then remains imprisoned in the remainder of the groove 60, whereby the flap 40 can not pivot in either direction. The orifice 61 is disposed sufficiently low so that it is never reached by the spherical button 62, except if one pulls the rod 48 outwardly while strongly compressing the spring 51 (FIG. 1).

The window shown in FIG. 1 presents notable advantages with respect to the prior art previously mentioned. The dimensions and weight of the mobile frame are similar to those of a window with triple glazing without an aeration circuit. In addition, its sealing means are likewise the same as those of conventional windows, hence do not present any particular problem. Finally, the frame elements may be made with conventional metal sections, in which it is not necessary to provide transversal passages or to accomodate a mechanism.

Another important advantage of the present invention is that it readily permits the connection of an electrical ventilator to the aeration circuit, since the latter necessarily passes through the fixed parts of the window. This ventilator may be disposed for example in the building and be connected to the outlet passage 36 either by the outlet opening 34, or by another opening disposed in the vicinity of a corner of the window. Such a ventilator may for example constitute a part of an air conditioner.

Figure 4:
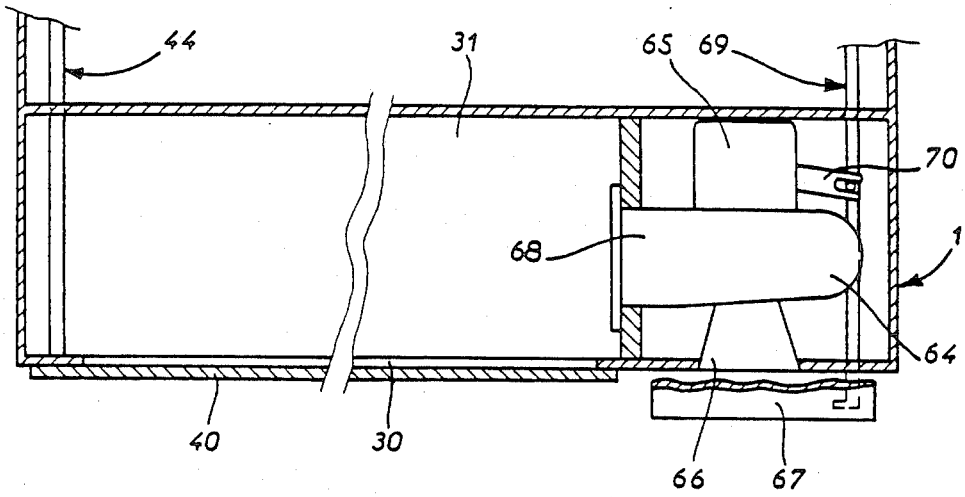
FIG. 4 is a schematic horizontal section through the lower part of a window frame comprising a ventilator.

FIG. 4 illustrates an advantageous arrangement of the ventilator 64 installed in the fixed frame of the window. This figure shows schematically in a horizontal section the inner passage 31 of the air circuit, the inlet opening 30 being closed off by the flap 40. The ventilator 64 is mounted in a separate compartment, near a corner of the window, and it is driven by an electric motor 65 which is likewise accomodated within the frame 1. On the suction side, the ventilator 64 is connected to a suction opening 66 provided in the outer face of the frame 1 and equipped with a closing flap 67 which may be of similar construction to the flap 40. The ventilator 64 comprises a delivery tube 68 which is connected directly to the inlet passage 31. Finally, a puller 69 having two positions is connected to the flap 67, as well as to a lever 70 controlling operation of the motor 65 so as to simultaneously provide opening of the flap 67 and starting operation of the ventilator 64.

The device represented in FIG. 4 may operate without the help of a ventilator, as described above. It is sufficient for this purpose to open the flap 40. If one wishes to produce forced aeration, one closes the flap 40 by means of the puller 44, and one opens the flap 67 by means of the puller 69, which brings about operation of the ventilator 64. The latter draws in outside air through the orifice 66 and delivers it into the interior of the building through the air circuit passing through the window. As this circuit is relatively long, and presents several baffles, noise produced by the ventilator is muffled.

Figure 5:
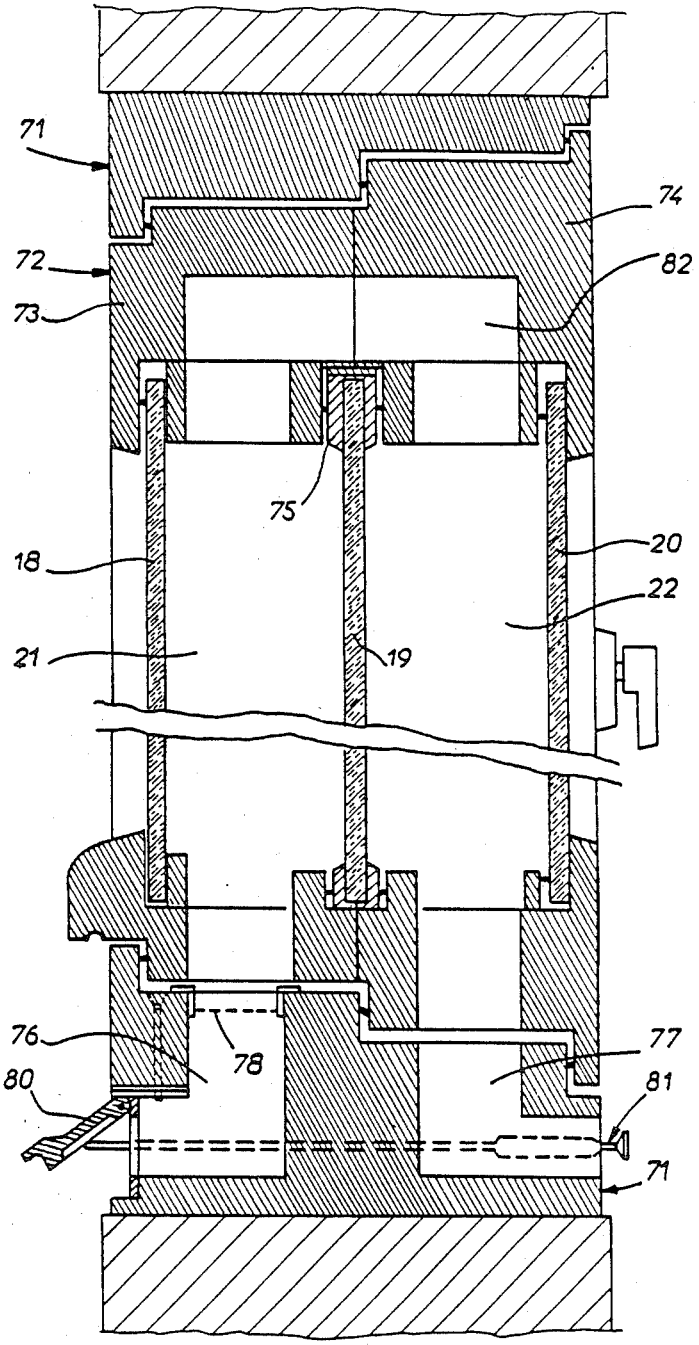
FIG. 5 is a schematic vertical section, similar to that of FIG. 1, of a variant.
Figure 6:
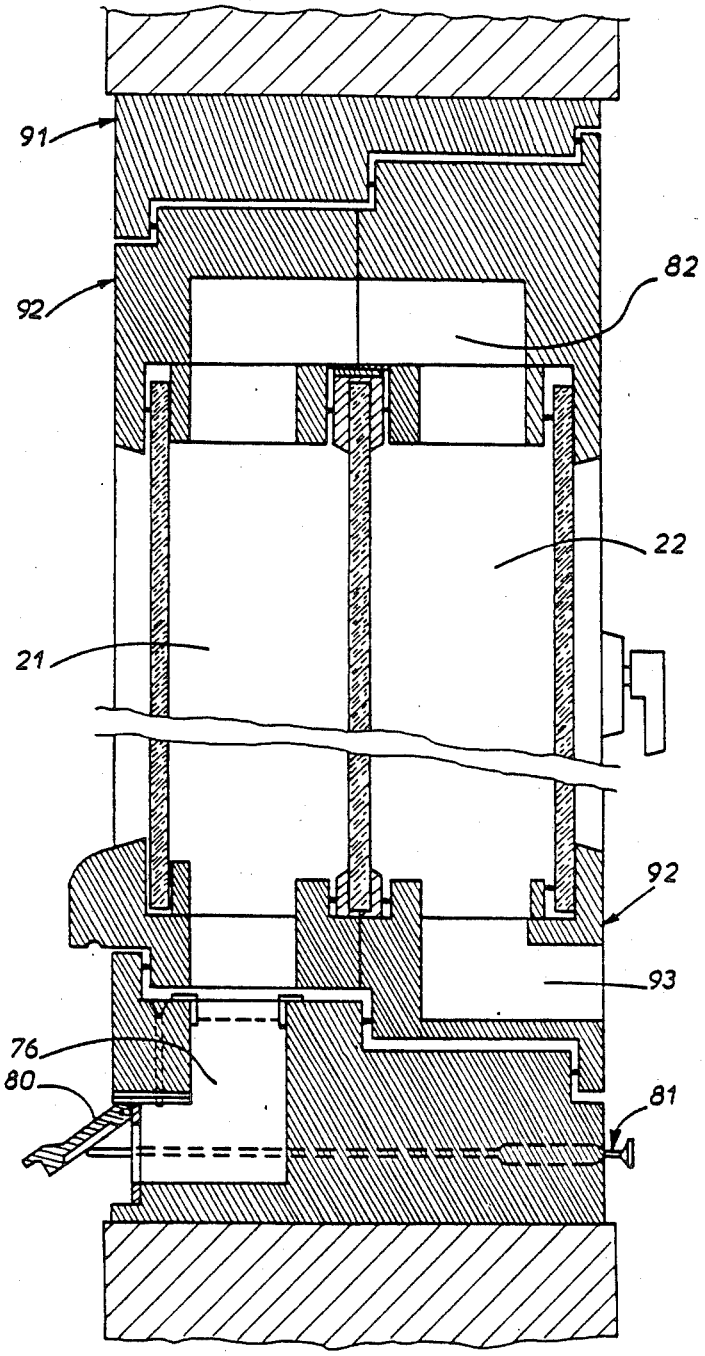
FIG. 6 is a schematic vertical section of another embodiment.

FIGS. 5 and 6 illustrate two other embodiments of the window according to the invention, in which the fixed frame and the mobile frame are made of wood.

The window illustrated in FIG. 5 comprises a fixed frame 71 and a mobile frame 72 which carries the three window panes 18, 19 and 20 disposed as in the previous case. The frame 72 is realized in two elements 73 and 74 which are articulated on each other in a conventional manner by means of hinges. The intermediate pane 19 is mounted between the two frame elements 73 and 74, by means of an auxiliary frame 75.

The aeration circuit passing through the window is in principle identical to that of the window in FIG. 1. It particularly comprises an inlet passage 76 and an outlet passage 77 which through both the fixed frame and the mobile frame in the lower part of the window. The inlet passage 76 is provided with a removable filter 78 and with an adjusting and closing flap 80 controlled by a puller 81. In the upper part of the frame 72, an intermediate passage 82 connects the two gaps 21 and 22 situated between the window panes.

The passages 76, 77 and 82 present simple forms and may be easily realized by milling longitudinal rectangular slits in the wood. According to the width of the frame, these slits may be continuous or may form a succession of several slits, between which braces exist to provide sufficient rigidity of the window. It should be remarked that the construction here illustrated is extremely simple. In addition, it allows three window panes to be utilized which have the same dimensions, this being of particular interest with regard to stocks of the manufacturer.

The examples described with reference to FIGS. 1 to 5 likewise illustrate another important advantage of the present invention. Thanks to the vertical arrangement of the inlet and outlet passages in the upper part of the mobile frame and thanks to the absence of control members in this frame, these constructions are particularly suitable for realizing an aeration circuit in a window of the guillotine type, that is to say one having a frame which is vertically mobile with respect to the window frame. It is understood that this aeration system may also be utilized for a window with a frame sliding horizontally.

The window represented in FIG. 6 comprises a fixed frame 91 and a mobile frame 92 which are realized in a very similar manner to the corresponding elements of the window of FIG. 5. The upper part of these two windows is identical. On the other hand, in the case of FIG. 6, the window comprises an outlet passage 93 which extends only through the mobile frame 92, while the inlet passage 76 is identical to that which has been described with reference to FIG. 5. In certain cases, this arrangement allows the height of the lower part of the window to be reduced by taking advantage of the fact that the greatest thickness of the mobile frame 92 is always situated on the inner side of the window, while the greatest thickness of the frame 91 is situated on the outer side.

The present invention is not limited to the described embodiments, but may extend to any modification or variant obvious to a person skilled in the art. In particular, the form and arrangement of the adjusting and closing flaps as well as their control members may have multiple variants. These flaps are not necessarily placed on the outer face of the window; they may also be disposed on the other face or in either the inlet or the outlet passage, within the fixed frame.

I claim:

1. In a window equipped with three parallel window panes and an aeration circuit comprising:

a fixed frame and a mobile frame formed of three frame elements consisting of an outer frame element and an inner frame element respectively supporting an outer pane, an intermediate pane and an inner pane defining therebetween two parallel gaps communicating via a first upper slit at the top of a first gap formed between said outer and inner panes, an upper intermediate passage and second upper slit at the top of a second gap between said intermediate and inner panes;

an external opening at the outer face of the window communicating with a first lower passage and a first lower slit at the bottom of said first gap, and an internal opening at the inner face of the window communicating with a second lower passage and a second lower slit at the bottom of said second gap; and flap means associated with control means;

the improvement wherein said three frame elements forming said mobile frame are respectively arranged so that said outer and intermediate frame elements define said first upper and lower slits with said first gap therebetween, and said intermediate and inner frame elements define said second upper and lower slits with said second gap therebetween, wherein said upper intermediate passage extends within said mobile frame above said intermediate frame element and between said outer and inner frame elements; and wherein said fixed frame contains in the bottom part thereof said external opening, said first lower passage and a first lower opening which are so arranged in the fixed frame that said external opening may communicate with the bottom of said first gap via said first lower passage and said first lower opening in the fixed frame and said first lower slit in the mobile frame and wherein said fixed frame further contains a flap and said control means which are thereby operatively associated with said external opening within said fixed frame.

2. Window according to claim 1, wherein said outlet passage passes only through the mobile frame.

3. Window according to claim 1, wherein the air circuit comprises a removable filter disposed in the fixed frame.

4. Window according to claim 1, wherein the three window panes have the same dimensions.

5. Window according to claim 1, wherein the mobile frame comprises three elements which are articulated with respect to each other, each of these elements serving as a frame for one of the window panes.

6. Window according to claim 1, wherein said flap is pivotable around a horizontal axis on at least one support solid with the fixed frame.

7. Window according to claim 6 characterized in that the flap is disposed on the outer face of the window.

8. Window according to claim 6 wherein said flap has a pivoting axis located higher than the opening to be shut, the flap being arranged in such a manner with respect to its pivoting axis that it tends to shut by its own weight.

9. Window according to claim 1, wherein said flap is adapted to shut the inlet opening.

10. Window according to claim 9, wherein said control means of the flap comprise a puller comprising a rod arranged to slide within the fixed frame, a handle fixed to the extremity of this puller on the inner side of the window, the outer extremity of the rod being in contact with the flap, and a latching mechanism with catches allowing locking of the puller in at least two given axial positions.

11. Window according to claim 10, wherein the second extremity of the rod and the flap comprises coupling means for actuating the flap by the puller in both directions.

12. Window according to claim 10, wherein the rod is connected to the handle by spring means.

13. Window according to claim 1, wherein said outlet passage passes through the fixed frame of the window.

14. Window according to claim 13 wherein an electric ventilator is connected to the aeration circuit.

15. Window according to claim 14 wherein that said ventilator constitutes a part of an air conditionor.

16. Window according to claim 14 wherein said ventilator is mounted in the fixed frame of the window.

17. Window according to claim 16, wherein said ventilator is disposed in parallel with said inlet opening, said ventilator being connected on one hand to an outer opening provided with a mobile closing member and on the other hand to the inlet passage, the fixed frame of the window being provided with means for controlling the ventilator and the closing member.

* * * * *